US010598054B2

(12) United States Patent
Swehla

(10) Patent No.: US 10,598,054 B2
(45) Date of Patent: Mar. 24, 2020

(54) VARIABLE RATIO ROCKER ARM SYSTEM

(71) Applicant: Deere & Company, Moline, IL (US)

(72) Inventor: Dale J. Swehla, Venice, FL (US)

(73) Assignee: DEERE & COMPANY, Moline, IL (US)

( * ) Notice: Subject to any disclaimer, the term of this patent is extended or adjusted under 35 U.S.C. 154(b) by 93 days.

(21) Appl. No.: 15/716,019

(22) Filed: Sep. 26, 2017

(65) Prior Publication Data

US 2019/0093526 A1 Mar. 28, 2019

(51) Int. Cl.

| | |
|---|---|
| ***F01L 13/00*** | (2006.01) |
| ***F01L 1/18*** | (2006.01) |
| ***F01L 1/24*** | (2006.01) |
| *F01L 1/053* | (2006.01) |
| *F01L 1/14* | (2006.01) |

(52) U.S. Cl.

CPC ..... *F01L 13/0021* (2013.01); *F01L 1/18* (2013.01); *F01L 1/181* (2013.01); *F01L 1/182* (2013.01); *F01L 1/2405* (2013.01); *F01L 1/146* (2013.01); *F01L 2001/0537* (2013.01); *F01L 2001/188* (2013.01); *F01L 2810/02* (2013.01); *F01L 2820/01* (2013.01)

(58) Field of Classification Search

CPC ..... F01L 13/0021; F01L 1/18; F01L 13/0063; F01L 2013/0068; F01L 2105/00

USPC ..... 123/90.16, 90.41, 90.39

See application file for complete search history.

(56) References Cited

U.S. PATENT DOCUMENTS

| | | | | |
|---|---|---|---|---|
| 4,721,007 A * | 1/1988 | Entzminger | F01L 1/12 | 123/90.16 |
| 5,456,224 A * | 10/1995 | Riley | F01L 13/0021 | 123/90.16 |
| 5,572,962 A * | 11/1996 | Riley | F01L 13/0021 | 123/90.16 |
| 5,791,306 A * | 8/1998 | Williamson | F01L 13/0021 | 123/90.16 |
| 8,763,572 B1 * | 7/2014 | Dike | F01L 1/182 | 123/90.16 |
| 9,732,639 B1 * | 8/2017 | Dike | F01L 1/053 | |

* cited by examiner

*Primary Examiner* — Patrick Hamo
*Assistant Examiner* — Wesley G Harris
(74) *Attorney, Agent, or Firm* — Klintworth & Rozenblat IP LLP

(57) ABSTRACT

A rocker arm system provides variable ratio valve actuation. A rocker arm extends between a pair of ends. One end receives a movement input and the second end delivers a movement output. The rocker arm reacts against a bearing cap to deliver the movement output in response to the movement input. The bearing cap includes a load surface facing the rocker arm that defines a trajectory of the rocker arm.

19 Claims, 8 Drawing Sheets

VARIABLE RATIO ROCKER ARM SYSTEM

CROSS-REFERENCE TO RELATED APPLICATION(S)

Not applicable.

STATEMENT OF FEDERALLY SPONSORED RESEARCH OR DEVELOPMENT

Not applicable.

FIELD OF THE DISCLOSURE

This disclosure relates to rocker arm systems for delivering movement, and to rocker arm systems that provide variable ratios for valve actuation.

BACKGROUND OF THE DISCLOSURE

Rocker arms are used in a variety of applications to transmit movement. For example, in certain internal combustion engine designs, rocker arms transmit motion to open and close the engine's valves for the admission of air and the expulsion of exhaust gases. An engine rocker arm system may operate with cam-in-block engines using push rods, in engines with overhead cams, or in engines with camless valve actuation. Rocker arm assemblies use a rocker arm shaft as the locating element and as the reciprocating rotational motion wear surface for the rocker arm. The shaft extends through an opening in the rocker arm dictating size requirements for the rocker arm structure and imposing constraints on rocker ratio options. Reciprocating motion of a rocker arm on the shaft inherently results in limited rotation of the mating surfaces under a constant load, which inhibits lubrication. Motion of a rocker arm may be driven by a camshaft that has lobes to open the valves. Manufacturability constraints on grinding the camshaft lobes limits that range of valve rates that are achievable. In addition, high loads may result on lifters, rocker arms and valves when aggressive lift in needed.

SUMMARY OF THE DISCLOSURE

The disclosure provides a rocker arm system with improved ability to provide variable valve ratios.

In one aspect, a rocker arm system includes a rocker arm that extends between a pair of ends. One end receives a movement input and the other end delivers a movement output. The rocker arm reacts against a bearing cap to deliver the movement output in response to the movement input. The bearing cap includes a load surface facing the rocker arm that defines a trajectory of the rocker arm In another aspect, a rocker arm system includes a valve and a cam that imparts movement to the rocker arm system to open and close the valve. The cam imparts the movement to one end of the rocker arm and the valve is engaged with the other end. A bearing cap has a load surface facing the rocker arm, that defines a trajectory of the rocker arm. The rocker arm moves through the trajectory when the cam imparts the movement.

In an additional aspect, a rocker system includes an engine defining a combustion chamber with a valve that opens and closes the combustion chamber. A rotating cam is disposed in the engine. The cam imparts a movement input to an end of the rocker arm and the valve is engaged with the other end of the rocker arm. The rocker arm delivers a movement output to the valve in response to the movement input. A bearing cap has a load surface facing the rocker arm that defines a trajectory of the rocker arm. The rocker arm moves through the trajectory when the cam imparts the movement input.

The details of one or more embodiments are set forth in the accompanying drawings and the description below. Other features and advantages will become apparent from the description, the drawings, and the claims.

BRIEF DESCRIPTION OF THE DRAWINGS

Like reference symbols in the various drawings indicate like elements.

DETAILED DESCRIPTION

Figure 1D:
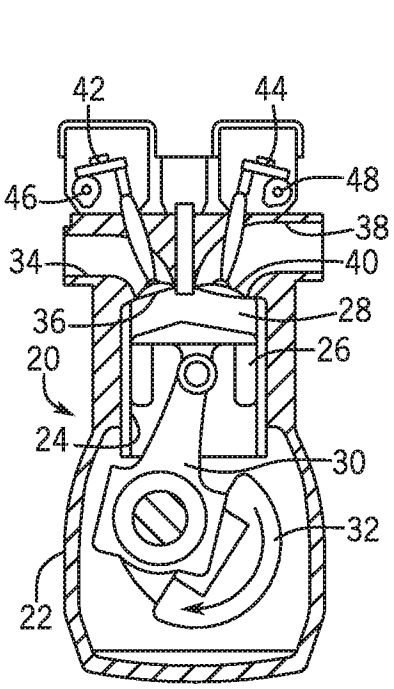
FIGS. 1A-1H are schematic cross-sectional illustrations of an engine including a rocker arm system in various operative states of a combustion cycle.

The following describes one or more example embodiments of a disclosed rocker arm system, as shown in the accompanying figures of the drawings described briefly above. Various modifications to the example embodiments may be contemplated by one of skill in the art.

The following description relates to a rocker arm system in the context of an internal combustion engine application for purposes of demonstrating an example. In internal combustion engines, rocker arm systems are employed for the purpose of transmitting movement to open and close valves. The present disclosure is not limited to internal combustion engine applications, but rather, also encompasses any application where a rocker arm transmits motion from one element to another.

In one or more example implementations of a disclosed rocker arm system, a pivotless rocker arm provides variable rocker ratios such as to enable accelerated valve lift events and reductions in valve head to valve seat velocities. Generally, the disclosed system includes a rocker arm that is free from the constraint imposed by otherwise being mounted on a pivot shaft. Instead, the back of the rocker arm rides, directly or indirectly, on a bearing cap. The bearing cap defines a trajectory through which the rocker arm moves when a movement input in imparted to the rocker arm, resulting in delivery of a movement output to the valve. The bearing cap and rocker arm arrangement broadens the valve rates and lift ratios that are possible. For example, valve lift off and seating rates are lowered to provide better mechanical advantage at low ratio conditions at opening and closing, where the loads are highest. In another example, high ratio lift provided by the bearing cap, prior to, during, and/or post peak lift results in a lower camshaft lift requirement. This simplifies camshaft lobe manufacturability with regard to the surface grinding radius and results in improved lifter to camshaft lobe contact. In some examples, the load bearing contact of the rocker arm to the bearing cap is provided by a rolling motion with reduced fiction and wear.

As noted above, the rocker arm system described herein may be employed in a variety of valve train types, or in applications other than valve trains. Referring to FIGS. 1A-1H, an example internal combustion engine 20 includes an engine block 22 defining a cylinder 24. It will be appreciated that in the simplified view of FIGS. 1A-1H, elements such as valve springs, lash adjusters, support structures, injectors and bearings are omitted for simplicity. In addition, the engine 20 may employ any number of cylinders arranged in any configuration such as in-line, opposed or V-type. In this example, a piston 26 is disposed in the cylinder 24 defining a combustion chamber 28 that varies in size as the piston 26 reciprocates during operation of the engine 20. The piston 26 is connected through a rod 30 with a crank 32, which turns with movement of the piston 26. In this example, the engine 20 includes an intake port 34 through which air enters the combustion chamber 28 when an intake valve 36 opens, and an exhaust port 38 allowing gases out of the combustion chamber 28 when exhaust valve 40 opens. The valves 36, 40 are driven by rocker arms 42, 44 respectively, which in this example are directly operated by cams 46, 48 in an overhead cam arrangement.

Figure 1C:
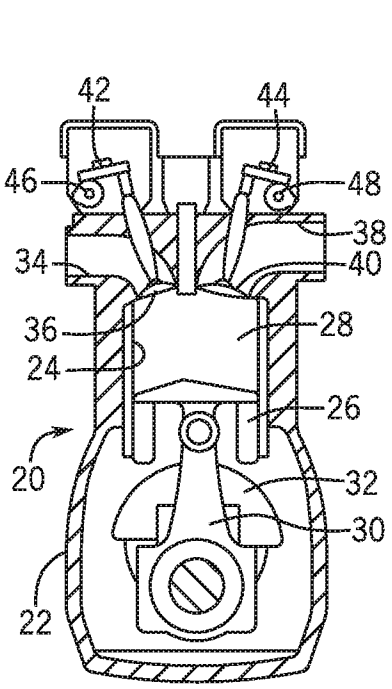
Figure 1B:
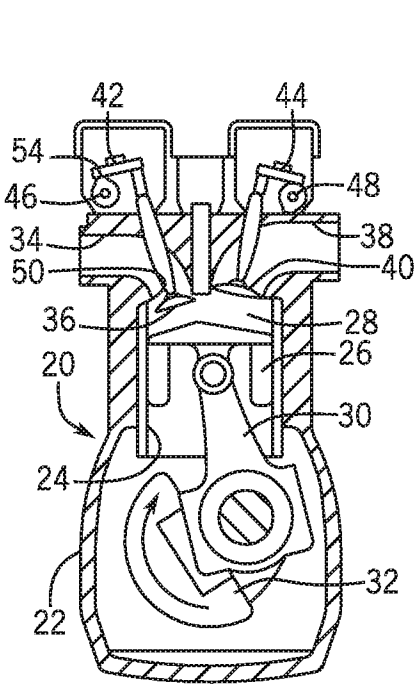
Figure 1A:
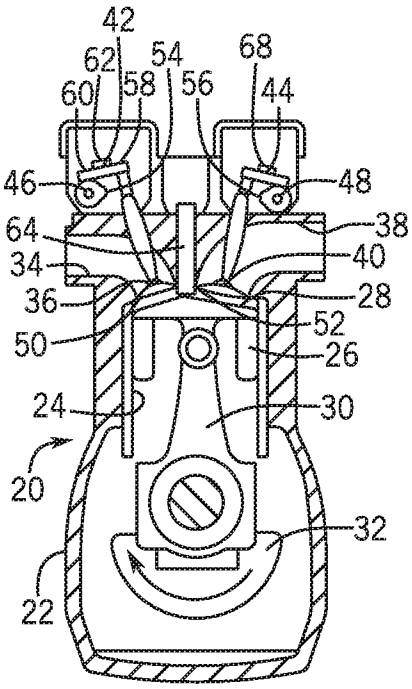

In FIG. 1A the piston 26 is at a position where the combustion chamber 28 is smallest (top dead center or TDC). The lobes 54, 56 of the cams 46, 48 respectively, are positioned off the rocker arms 42, 44. As a result, the intake valve 36 is closed and seated on valve seat 50, and the exhaust valve 40 is closed and seated on valve seat 52. When the piston 26 moves downward in the cylinder 24 during an intake stroke and the crank 32 turns as depicted in FIG. 1B, the cam 46 turns in coordination, and the lobe 54 registers with the rocker arm 42 providing a movement input thereto. In response to the movement input, the rocker arm 42 provides a movement output that pushes the intake valve 36 off the valve seat 50, opening the intake port 34 to the combustion chamber 28. Air is drawn into the combustion chamber 28 by the moving piston 26. Fuel is introduced either into the entering air stream or through an injector (not shown). In this example, the amount the intake valve 36 moves off the valve seat 50 (lift) and the rate (speed) at which the intake valve 36 moves are determined by the shape and size of the lobe 54 and also by the characteristics of the rocker arm 42. Rocker arm ratio refers to the amount of movement on the valve end 58 of the rocker arm 42 compared to the amount of movement on the cam end 60. A higher ratio rocker arm increases the lift by providing more movement on the valve end 58, and also means that the valve moves at a faster rate, since it travels a greater distance in the same amount of time. Greater lift enables the engine to move more air and exhaust gas, which provides a power benefit. In the current example, the rocker arm 42 bears against and rides on a bearing cap 62, which enables providing a higher rocker arm ratio while at the same time slowing valve speed when lifting off the valve seat 50 as further described below.

Figure 1H:
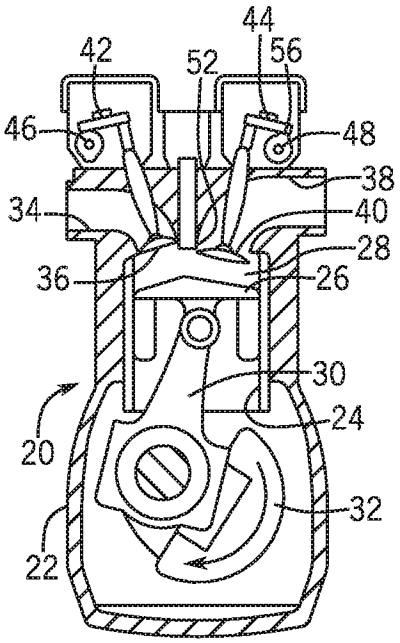

From the intake stroke of FIG. 1B, the piston 26 reaches a position where the combustion chamber 28 is largest (bottom dead center or BDC), as shown in FIG. 1C. The piston 26 then begins a compression stroke as shown in FIG. 1D. The valves 36, 40 are closed as the air and fuel mixture in the combustion chamber 28 is compressed. In some examples, the intake valve 36 remains open a few degrees of crankshaft rotation after BDC. When the piston 26 again reaches TDC as shown in FIG. 1E, the compressed air and fuel is ignited, such as by a spark plug 64, to release energy. As shown in FIG. 1F, the engine 20 enters a power stroke as hot expanding gases force the piston 26 to expand the combustion chamber 28, rotating the crank 32. During the power stroke, valves 36, 40 are closed.

Figure 1G:
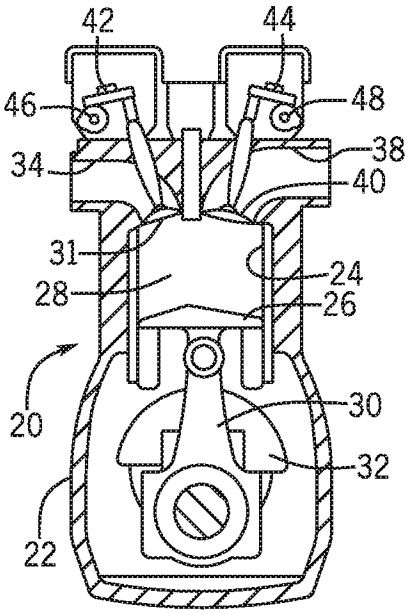
Figure 1F:
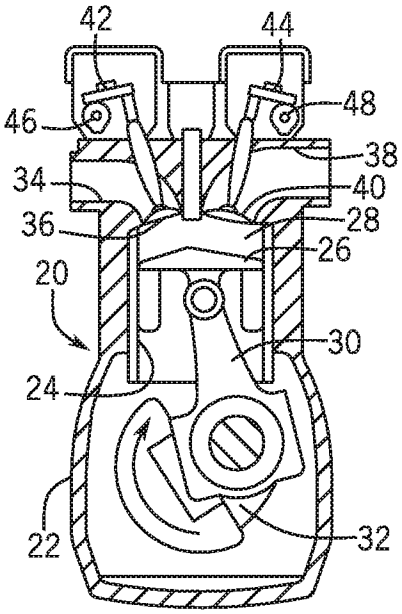
Figure 1E:
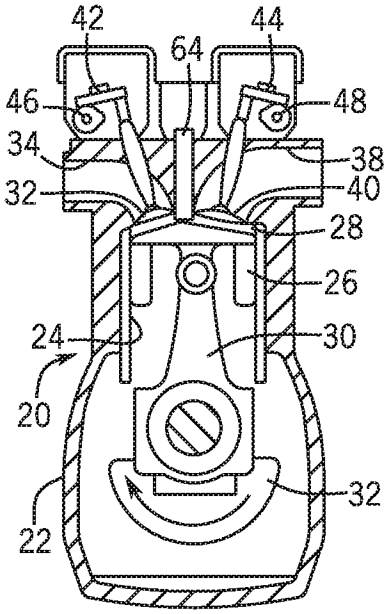

At the end of the power stroke the engine returns to BDC as shown in FIG. 1G. The engine 20 next enters an exhaust stroke as shown in FIG. 1H, to clear gases from the combustion chamber 28 through the exhaust port 38. The exhaust valve 40 is opened and the intake valve 36 remains closed. When the piston 26 moves upward in the cylinder 24 during an exhaust stroke and the crank 32 turns, the cam 48 turns in coordination. The lobe 56 registers with the rocker arm 44 providing a movement input thereto. The rocker arm 44 transmits the movement input providing a movement output that pushes the exhaust valve 40 off the valve seat 52 opening the exhaust port 38 to the combustion chamber 28. Movement of the piston 26 evacuates exhaust gases to the atmosphere. At the end of the exhaust stroke the piston 26 returns to TDC, the exhaust valve 40 is closed, and one operating cycle of the engine 20 is complete. Opening and closing of the exhaust valve 40 is controlled by the rocker arm 44. The rocker arm 44 moves on a bearing cap 68. In general, the bearing cap 68 enhances the ability to provide different lift ratios based on desired movements of the exhaust valve 40, as further detailed below. For example, the bearing cap 68 may be tuned to improve valve lift off, valve seating, and to provide an improved mechanical advantage at low ratio conditions, such as at opening and closing where the loads are highest. High ratios may be provided at other times without relying solely on the surface of the cam 48 to provide the lift and rate requirements. Lift and rate options may be achieved through use of the bearing cap 68 that camshaft lobe surface grind radius alone cannot provide. As a result, the cam 48 may be formed to provide improved lobe 56 contact, rather than to provide the entire input needed for the lift and rate requirements. The rocker arm 44 and bearing cap 68 interaction may provide variable rocker ratio with accelerated valve lift and reduced valve seating velocities.

Figure 2:
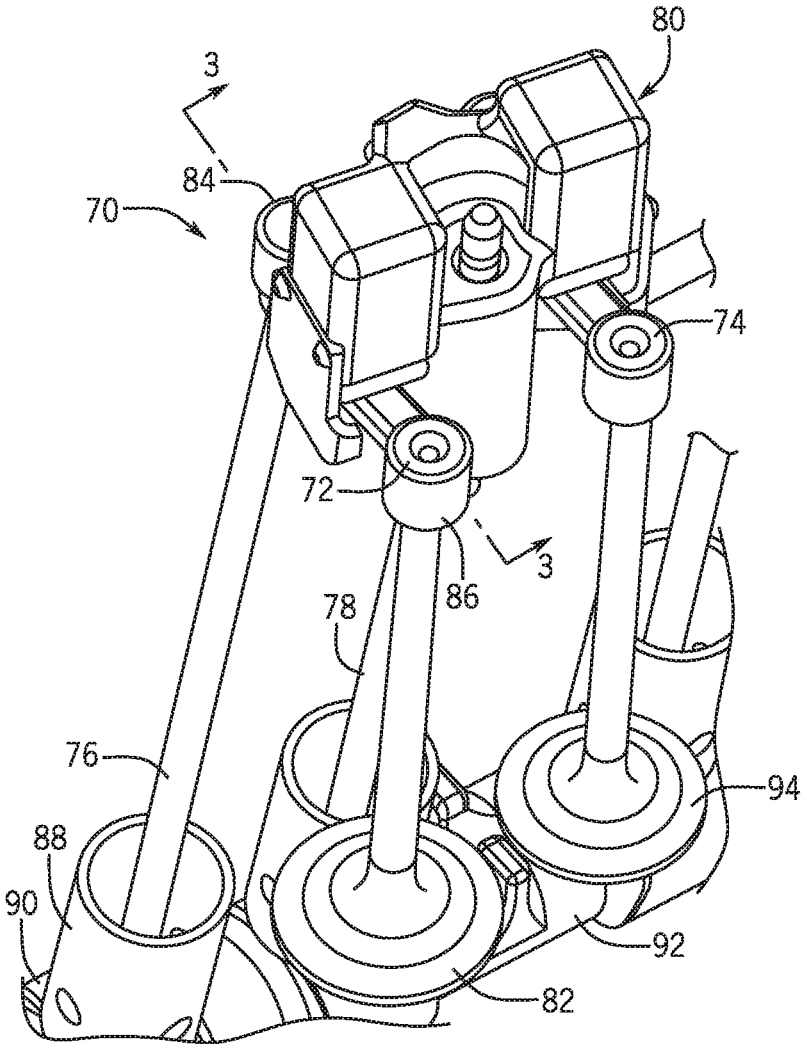
FIG. 2 is a partial perspective view of a rocker arm system with the engine block and head removed.

In various embodiments, as illustrated in FIG. 2, a rocker arm system 70 includes, for example, rocker arms 72, 74 operated by push rods 76, 78 respectively. The engine with which the rocker arm system 70 operates may have any number of valves and respective rocker arms. In the illustration of FIG. 2, the engine block and head are removed to show details of the rocker arm system 70. The rocker arms 72, 74 are mounted in a paired configuration in a tower assembly 80. It will be appreciated that the paired tower configuration is an example of mounting the rocker arms 72, 74 and other examples are contemplated. In addition, although the rocker arms 72, 74 are mounted in pairs, they operate independently. The rocker arm 72 extends between a cam end 84 and a valve end 86 and operates a valve 82. The valve 82 may operate for intake or for exhaust purposes. The push rod 76 engages the cam end 84 of the rocker arm 72 and extends to a lifter 88, which rides on a cam 90 of a camshaft 92. Accordingly, the rocker arm 72, and in particular the cam end 84, moves in response to the rotating cam 90 and the distance that its surface varies from the center of rotation of the camshaft 92. Similarly, the rocker arm 74 operates a valve 94 in response to movement of the push rod 78 as a result of rotation of its respective cam on the camshaft 92.

Figure 3:
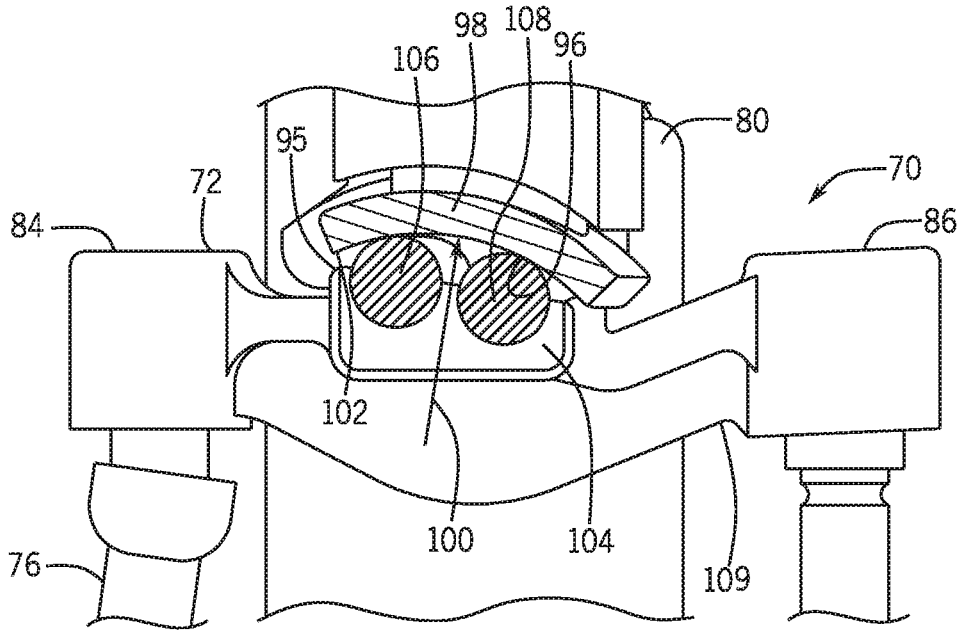
FIG. 3 is a partial cross-sectional illustration taken generally through the line 3-3 in FIG. 2.
Figure 4:
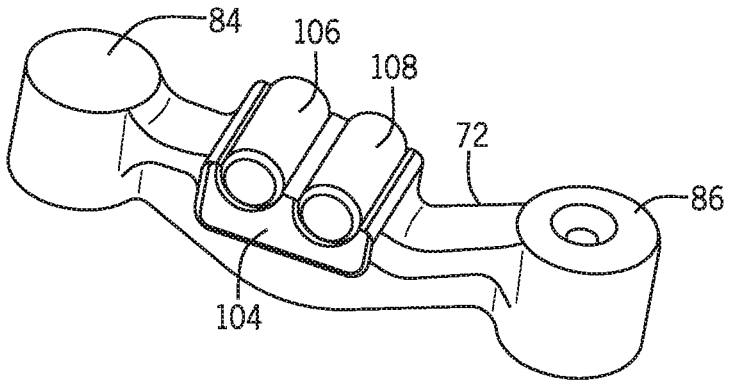
FIG. 4 is a perspective view of a rocker arm and rollers of the system of FIG. 2.

Referring to FIG. 3, a cross-section through the tower assembly 80 is shown. The rocker arm 72 is mounted in the tower assembly 80 without being fixed on a pivot shaft and instead moves along a load surface 96 of a bearing cap 98 that is positioned in the tower assembly 80 adjacent the back 95 of the rocker arm 72. As a result, movement options of the rocker arm 72 are not constrained by a fixed pivot shaft. Instead, the load surface 96 contributes to defining the trajectory of the rocker arm 72. The load surface 96 is generally concave with respect to its side facing the back 95 of the rocker arm 72, and includes a radius 100 that may vary along its length 102. In this example, the rocker arm 72 includes a cage 104 that holds a pair of rollers 106, 108. The rollers 106, 108 ride on and roll along the load surface 96. Accordingly, the rocker arm 72 engages the load surface 96 indirectly through the rollers 106, 108. The valve 82 and the push rod 76 engage the rocker arm 72 on its side 109 that is opposite the back 95. The valve 82 pushes against the valve end 86 and the push rod 76 pushes against the cam end 84, which forces the rollers 106, 108 against the load surface 96. With additional reference to FIG. 4, the rollers 106, 108 are contained in the cage 104 within which they are allowed to roll but are otherwise fixed in location relative to the rocker arm 72. In this example, the rollers 106, 108 are formed in a cylindrical configuration with a length greater than their diameter, but may take other shapes such as spherical or barrel. When moved by the push rod 76, the rocker arm 72 moves on a path determined by rolling of the rollers 106, 108 along the load surface 96.

Figure 5:
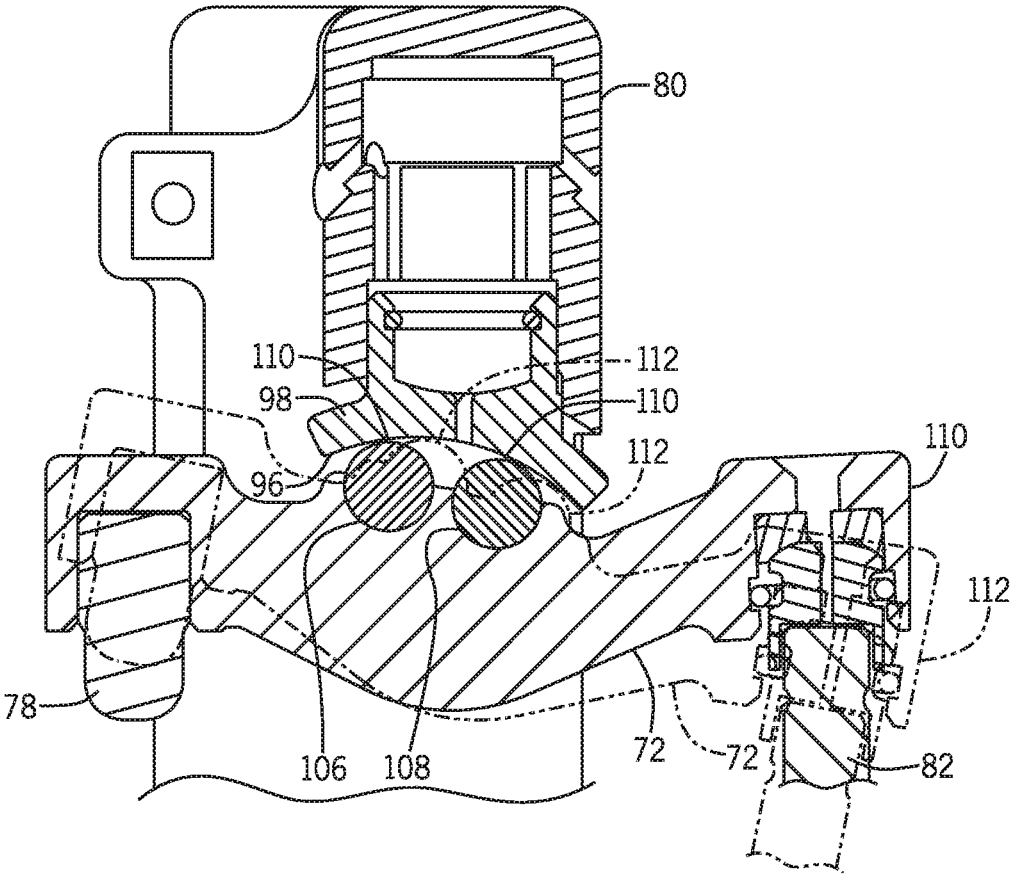
FIG. 5 is a partial cross-sectional illustration of a rocker arm system with the rocker arm shown in two different positions to impart movement.
Figure 6:
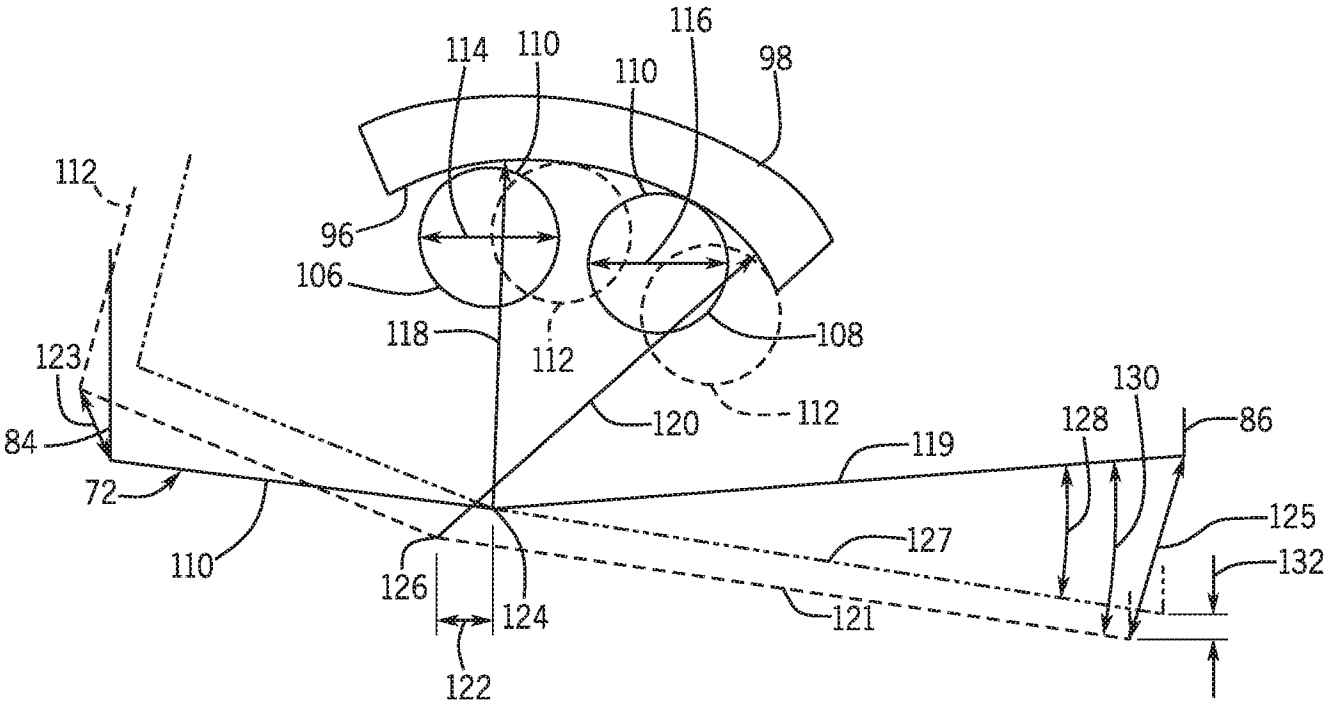
FIG. 6 is a diagrammatic illustration of the rocker arm system of FIG. 5 showing the rocker arm's trajectory.

Referring to FIG. 5, the rocker arm 72 is shown in a valve closed position 110 and a valve open position 112. As the rollers 106, 108 roll along the load surface 96 between the valve closed position 110 and the valve open position 112, the rate of the valve end 86 of the rocker arm 72 may be accelerated or decelerated by changes in the curvature radius of the load surface 96 and/or in the diameters of the rollers 106, 108. Referring additionally to FIG. 6, the rollers 106, 108 have diameters 114, 116 respectively, that are tuned for the desired response of the valve 82. For example, increasing the diameter of the rollers 106, 108 results in greater and faster movement of the valve 82. Also for example, the roller 108 may have a diameter 116 that is smaller than the diameter 114 of the roller 106 to provide a slower movement of the valve 82 as it seats. Operation of the rocker arm 72 includes rolling of the rollers 106, 108 along the load surface 96. In this example, the load surface 96 has a varying curvature that includes a radius 118 and a radius 120. In this example, the radius 120 is greater than the radius 118, for example the radii 120, 118 are 24 millimeters and 20 millimeters respectively. When the rocker arm system 70 is near the valve closed position 110, the rollers 106, 108 experience the smaller radius 118, and therefore the rocker arm 72 operates as a smaller lever. As a result, the valve 82 moves slower when approaching or lifting off its valve seat. The valve 82 is accelerated to move faster when the rollers 106, 108 move into the area of the radius 120 where the rocker arm 72 operates as a larger lever to more quickly move the valve 82. Slowing movement of the valve 82 provides a better mechanical advantage at low ratio conditions at opening and closing, where the loads are highest. In addition, when the valve 82 is seating, slower movement reduces the likelihood of bounce.

As illustrated in FIG. 6, in this example the rocker arm 72 moves through a trajectory from position 119, corresponding to the valve closed position 110 to a position 121, corresponding to the valve open position 112. The cam end 84 moves through a trajectory 123 and the valve end 86 moves through a trajectory 125. Also as the rocker arm 72 moves through its trajectory it rotates about a moving center that translates a distance 122 as the push rod 76 moves the rocker arm 72. The distance 122 is the distance from a center 124 defined by the radius 118 and a center 126 defined by the radius 120. In the current example, the distance 122 is 4.3 millimeters. In the current example, the trajectory of the rocker arm 72 includes the trajectory 123 of the cam end 84, the trajectory 125 of the valve end 86 and the movement of between the center 124 and the center 126. If, instead of the current example, the rocker arm 72 had a fixed center at center 124, a lift 128 would result as the rocker arm 72 would move from the position 119 to a position 127. It should be appreciated that the position 127 is given to demonstrate the advantage provided by the current example, which results the position 121 which provides greater lift 130 as compared to the position 127. With the variable radius 118, 120 of the load surface 96, the rocker arm 72 provides a variable ratio as it provides the lift 130. In the current example the lift increase 132 from lift 128 to lift 130 is 0.6 millimeters of additional movement of the valve 82.

Figure 7:
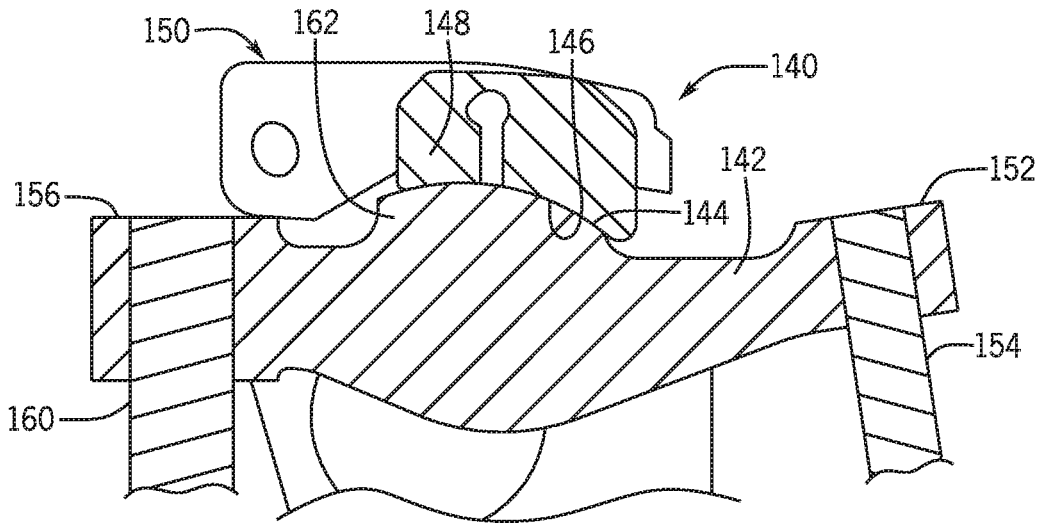
FIG. 7 is a partial cross-sectional illustration of part of a rocker arm system with a wear pad.
Figure 8:
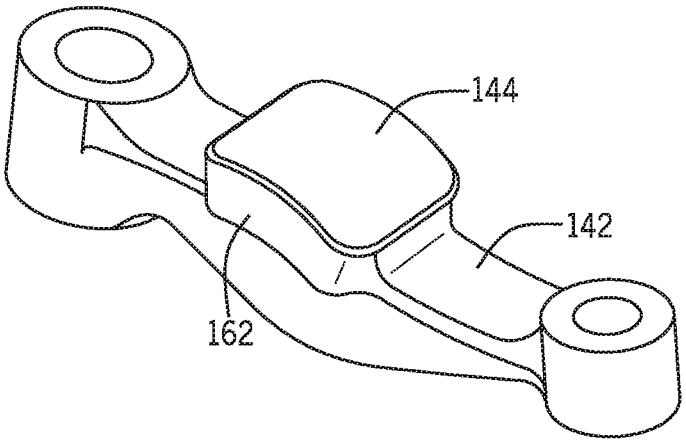
FIG. 8 is a perspective illustration of the rocker arm of the system of FIG. 7.

In an embodiment as illustrated in FIGS. 7 and 8, a rocker arm system 140 includes a rocker arm 142 with a bearing surface 144. The bearing surface 144 mates with a load surface 146 of a bearing cap 148. Accordingly, the rocker arm 142 directly engages the load surface 146. The bearing cap 48 is positioned in a tower assembly 150 that is fixed to an associated engine (not shown). The rocker arm 142 includes a valve end 152 engaged with a valve 154 and a cam end 156 engaged with a push rod 160. In response to movement of the push rod 160, the rocker arm moves as a result of the bearing surface 144 sliding along the load surface 146. In this example the lift and rate of the valve 154 is effected by the curvatures of both the bearing surface 144 and the load surface 146. Accordingly, the rate and/or the amount of lift provided is varied by varying the curvature of one or both of the bearing surface 144 or the load surface 146. The bearing surface 144 is formed as part of a pad 162 of the rocker arm 142 that may be provided as an integral part of the rocker arm 142, or a separate piece. The push rod 160 and the valve 154 push the bearing surface 144 against the load surface 146. Operative contact is established between the rocker arm 142 and each of the bearing cap 148, the push rod 160 and the valve 154. The rocker arm 142 moves along the load surface 146 without being constrained by a pivot shaft extending through the rocker arm 142. Accordingly, the rocker arm 142 may move in a sliding, rocking and/or rolling action with available movement options that change by incorporating variable radii for the curvatures of the load surface 146 and/or the bearing surface 144.

Figure 9:
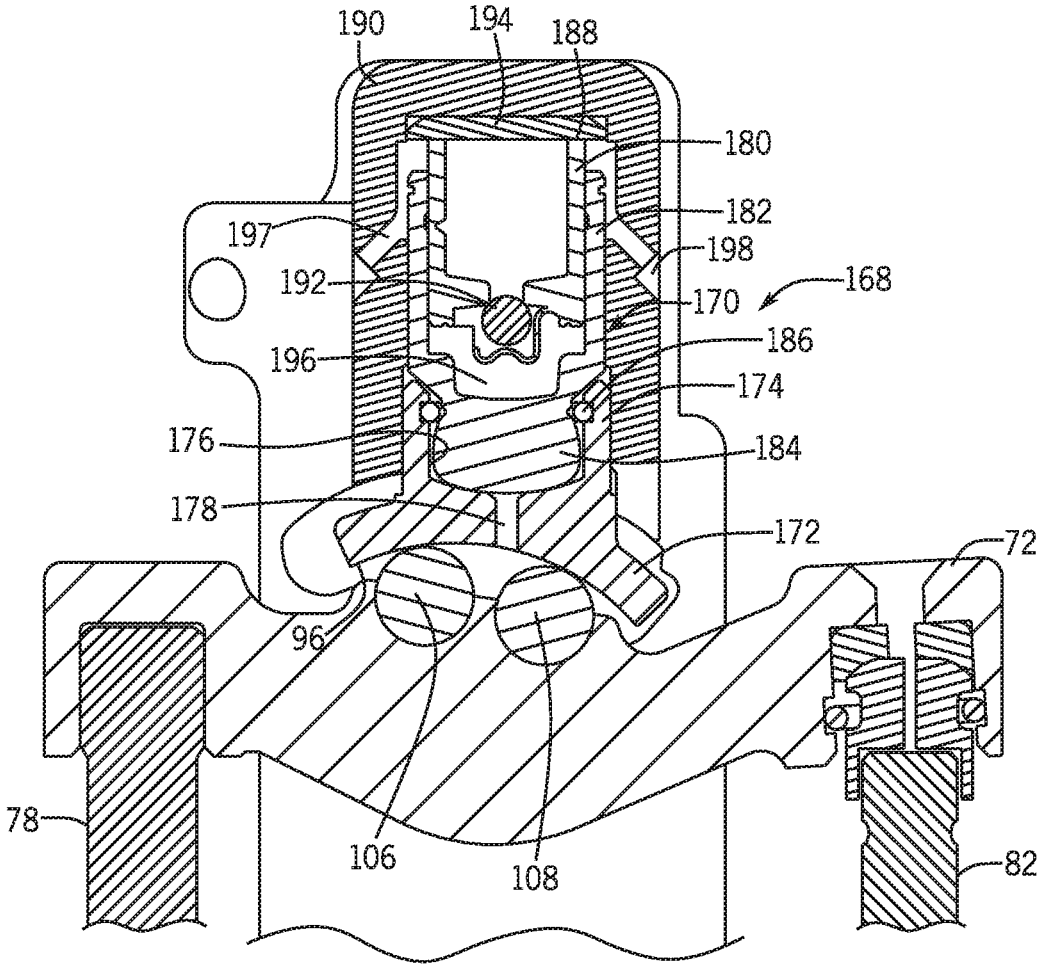
FIG. 9 is a partial cross-sectional illustration of a rocker arm system with a hydraulic lash adjuster.

In an embodiment as illustrated in FIG. 9, a rocker arm system 168 includes valve train lash adjustment, via a hydraulic lash adjuster (HLA) 170. In general, the HLA 170 adjusts the position of the bearing cap 98 relative to the rocker arm 72 by oil pressure supplied through the tower assembly 80. The HLA 170 is positioned behind the bearing cap 98 from the rocker arm 72 and equalizes the accumulated tolerance stack up between the pushrod 76 and the valve 82, while maintaining rocker arm geometry. The bearing cap 98 includes a curved plate 172 with the load surface 96 and includes a cylindrical extension 174 with a hollow interior 176. An oil hole 178 extends through the curved plate 172 and registers with the hollow interior 176. The HLA 170 includes an inner plunger 180 and an outer plunger 182. The outer plunger 182 includes an extension 184 that is received within the hollow interior 176 and is retained therein by a ring 186. The inner plunger 180 is received within the outer plunger 182 and includes an end 188 backed-up and supported by the tower housing 190, in this example by a plate 194. Oil is supplied through the inner plunger 180 and through ball check 192 to a chamber 196 between the inner and outer plungers 180, 182 forcing the outer plunger 182 and the bearing cap 98 against the rollers 106, 108. The oil is trapped in the chamber 196 by the ball check 192. The supply of oil automatically maintains contact between the elements in the valve train. In this example, the HLA 170 includes an oil jet 197 directed at the interface between the rocker arm 72 and the push rod 78 to supply lubrication thereto, and an oil jet 198 directed at the interface between the valve 92 and the rocker arm 72 to provide lubrication thereto.

Through the examples described above, a rocker arm system includes a rocker arm that is free from the constraint imposed by otherwise mounting on a pivot shaft. Instead, the back of the rocker arm rides, directly or indirectly, on a bearing cap. The bearing cap and rocker arm arrangement broadens the valve rates and lift ratios that are possible in a given valve train.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. Explicitly referenced embodiments herein were chosen and described to best explain the principles of the disclosure and their practical application, and to enable others of ordinary skill in the art to understand the disclosure and recognize many alternatives, modifications, and variations on the described example(s). Accordingly, various embodiments and implementations other than those explicitly described are within the scope of the following claims.

What is claimed is:

1. A rocker arm system comprising:

a rocker arm extending from a first end to a second end, the first end configured to receive a movement input and the second end configured to deliver a movement output;

a bearing cap against which the rocker arm is configured to react to deliver the movement output in response to the movement input, the bearing cap including a load surface facing the rocker arm that defines a trajectory of the rocker arm; and a roller disposed between the rocker arm and the bearing cap and configured to roll along the load surface when the rocker arm moves through the trajectory;

wherein the load surface defines variable curvatures having radii that differ from one another to vary a rate of the movement output.

2. The rocker arm system of claim 1, further comprising a valve engaged with the second end to receive the movement output, the valve configured to open or close in response to the movement output.

3. The rocker arm system of claim 2, further comprising a cam configured to deliver the movement input to the first end.

4. The rocker arm system of claim 1, further comprising a second roller disposed between the rocker arm and the bearing cap and configured to roll along the load surface when the rocker arm moves through the trajectory.

5. The rocker arm system of claim 4, wherein the roller and the second roller have diameters that differ from one another.

6. The rocker arm system of claim 1, further comprising:

a valve engaged with the second end to receive the movement output, the valve configured to open or close in response to the movement output;

a push rod engaged with the first end through which the rocker arm receives the movement input; and a cam, wherein the push rod extends between the cam and the first end, wherein the cam is configured to impart the movement input to the first end through the push rod.

7. The rocker arm system of claim 1, wherein the rocker arm is not constrained by a fixed pivot shaft.

8. The rocker arm system of claim 7, wherein the rocker arm has a center of rotation that moves when the rocker arm moves through the trajectory.

9. A rocker arm system comprising:

a rocker arm extending from a first end to a second end, the first end configured to receive a movement input and the second end configured to deliver a movement output;

a bearing cap against which the rocker arm is configured to react to deliver the movement output in response to the movement input, the bearing cap including a load surface facing the rocker arm that defines a trajectory of the rocker arm; and a lift adjuster engaging the bearing cap on a side opposite the rocker arm, the lift adjuster configured to force the bearing cap toward the rocker arm to adjust the rocker arm system.

10. A rocker arm system comprising:

a valve configured to open and close;

a cam configured to impart movement to the rocker arm system;

a rocker arm extending between a first end and a second end, the cam imparting the movement to the rocker arm at the first end and the valve engaged with the rocker arm at the second end;

a bearing cap that has a load surface facing the rocker arm, the load surface defining a trajectory of the rocker arm, wherein the rocker arm is configured to move through the trajectory when the cam imparts the movement; and a roller disposed between the rocker arm and the bearing cap and configured to roll along the load surface when the cam imparts the movement.

11. The rocker arm system of claim 10, further comprising a second roller disposed between the rocker arm and the bearing cap and configured to roll along the load surface when the cam imparts the movement.

12. The rocker arm system of claim 11, wherein the roller and the second roller have diameters that differ from one another.

13. The rocker arm system of claim 11, wherein the rocker arm includes a cage within which the roller and the second roller are disposed.

14. The rocker arm system of claim 10, wherein the load surface defines variable curvatures having radii that differ from one another configured to move the rocker arm at different rates when the cam imparts the movement.

15. The rocker arm system of claim 10, wherein the rocker arm has a center of rotation that moves when the rocker arm moves through the trajectory.

16. The rocker arm system of claim 15, wherein the load surface defines curvatures of differing radii configured to move the second end at varying rates when the rocker arm moves through the trajectory.

17. The rocker arm system of claim 10, wherein the bearing cap comprises a curved plate disposed on an opposite side of the rocker arm from the valve and the cam.

18. The rocker arm system of claim 10, further comprising a push rod, wherein the cam engages the first end through the push rod, and wherein the push rod and the bearing cap determine positioning of the rocker arm throughout the trajectory.

19. A rocker arm system comprising:

an engine defining a combustion chamber;

a valve configured to open and close the combustion chamber;

a cam disposed in the engine and configured to rotate;

a rocker arm extending between a first end and a second end, the cam configured to impart a movement input to the rocker arm at the first end and the valve engaged with the rocker arm at the second end, the rocker arm configured to deliver a movement output to the valve in response to the movement input;

a bearing cap that has a load surface facing the rocker arm, the load surface configured to define a trajectory of the rocker arm, wherein the rocker arm is configured to move through the trajectory when the cam imparts the movement input; and a roller disposed between the rocker arm and the bearing cap and configured to roll along the load surface when the cam imparts the movement input.

* * * * *